US011192673B2

(12) United States Patent
Seelos et al.

(10) Patent No.: US 11,192,673 B2
(45) Date of Patent: Dec. 7, 2021

(54) TOOL FOR MOUNTING A TENSION CLAMP

(71) Applicant: Oetiker Schweiz AG, Horgen (CH)

(72) Inventors: Robert Seelos, Rüschlikon (CH); Nelson De Vittori, Richterswil (CH); Peter Steiner, Alpthal (CH)

(73) Assignee: Oetiker Schweiz AG, Horgen (CH)

( * ) Notice: Subject to any disclaimer, the term of this patent is extended or adjusted under 35 U.S.C. 154(b) by 508 days.

(21) Appl. No.: 15/535,468

(22) PCT Filed: Dec. 16, 2015

(86) PCT No.: PCT/EP2015/079988
§ 371 (c)(1),
(2) Date: Jun. 13, 2017

(87) PCT Pub. No.: WO2016/096983
PCT Pub. Date: Jun. 23, 2016

(65) Prior Publication Data

US 2017/0349307 A1 Dec. 7, 2017

(30) Foreign Application Priority Data

Dec. 17, 2014 (WO) ..... PCT/EP2014/078344

(51) Int. Cl.
*B65B 13/30* (2006.01)
*B25B 25/00* (2006.01)
(Continued)

(52) U.S. Cl.
CPC ..... *B65B 13/30* (2013.01); *B21D 39/031* (2013.01); *B25B 25/005* (2013.01); *B65B 13/02* (2013.01);
(Continued)

(58) Field of Classification Search
CPC ..... B65B 13/02; B65B 13/027; B65B 13/30; B65B 13/305; B65B 13/34; B65B 13/345;
(Continued)

(56) References Cited

U.S. PATENT DOCUMENTS 1,988,742 A * 1/1935 MacChesney ..... B65D 63/06 24/23 W
2,087,655 A * 7/1937 Prestwich ..... B65B 13/305 140/93.2
(Continued)

FOREIGN PATENT DOCUMENTS

JP 2014529714 A 11/2014

OTHER PUBLICATIONS

Buchkremer et al. "Analytical study on the relationship between chip geometry and equivalent strain distribution on the free surface of chips in metal cutting". May 15, 2014. International Journal of Mechanical Sciences, pp. 88-103. (Year: 2014).*
(Continued)

*Primary Examiner* — Adam J Eiseman
*Assistant Examiner* — P Derek Pressley
(74) *Attorney, Agent, or Firm* — Bond Schoeneck & King, PLLC; George McGuire

(57) ABSTRACT

A tension clamp (19) includes a band (20) surrounding an object to be fastened and a buckle (21) arranged on the inner band end portion (22) and surrounding the band (20), with the outer band end portion (23) extending through the buckle (21). A tool for mounting the tension clamp includes a holding device for holding the buckle (21) along with the band (20) surrounding the object to be fastened, a tensioning device for tensioning the band (20) round the object to be fastened by applying tension to the outer band end portion (23), a locking device (50) for locking the buckle (21) on the band (20), and a severing device for cutting off excessive band length. The locking device (50) has plier jaws (54) adapted to be inserted into lateral windows (25) of the buckle (21) for deforming side edge portions (24) of the other band end portion (23).

16 Claims, 10 Drawing Sheets

(51) Int. Cl.
*B65D 63/08* (2006.01)
*B65B 13/02* (2006.01)
*B21D 39/03* (2006.01)

(52) U.S. Cl.
CPC ..... *B65B 13/027* (2013.01); *B65B 13/305* (2013.01); *B65D 63/08* (2013.01)

(58) Field of Classification Search
CPC ..... B65D 63/04; B65D 63/08; B65D 63/16; B21D 39/031; B25B 25/005
USPC ..... 100/30; 24/20 W, 23 W
See application file for complete search history.

(56) References Cited

U.S. PATENT DOCUMENTS 2,118,158 A * 5/1938 Carlson ..... B65D 63/06 24/23 W
2,375,769 A * 5/1945 Childress ..... B65B 13/345 140/93.4
2,837,949 A * 6/1958 Lodholm ..... B25B 25/005 81/9.3
3,034,384 A * 5/1962 Novak ..... B65B 13/345 140/154
3,396,760 A * 8/1968 Kirsinas ..... B65B 13/345 140/93.4
3,641,629 A * 2/1972 Beardsley ..... B65B 13/345 24/23 W
3,698,310 A * 10/1972 Plattner ..... B65B 13/34 100/4
8,051,881 B2 * 11/2011 Segroves ..... H02G 1/00 100/29
10,322,831 B2 * 6/2019 Nasiatka ..... B65B 13/345
2009/0241298 A1 * 10/2009 Figiel ..... B65D 63/06 24/16 R

OTHER PUBLICATIONS

International Search Report Form PCT/ISA/210, International Application No. PCT/ep2015/079988, pp. 1-8, dated May 18, 2016.

* cited by examiner

TOOL FOR MOUNTING A TENSION CLAMP

PRIOR ART

For mounting an object such as an air bag material on a gas generator or an air bag on a mounting plate, tension clamps, such as known from U.S. Pat. No. 8,424,166 B2, are used which consist of a band and a buckle disposed on one end portion of the band.

U.S. 2009/0114308 A1 discloses a tool by which such a tension clamp, which has been pre-assembled from a band and a buckle and placed on the object, is tensioned round the object, the buckle is subsequently locked on the band, and the excessive length of the outer band end is cut off. To do so, the object to be fastened including the tension clamp is placed in a holder, the outer band end is clamped between a tensioning roller and a pressure roller, and the tensioning roller is rotated. When a given band tension or a given rotation of the pressure roller is reached the band is locked to the buckle by being deformed within the buckle using a spring-loaded plunger. At the same time, the outer band end which projects from the buckle is cut off by means of a cutting wheel which is rotated together with the plunger.

Deforming the band within the buckle requires the object to be fastened as a counter element to receive the force exerted by the plunger. This involves the risk of the object to be fastened being damaged.

As another disadvantage of the known tool, the cutting of the band generates a sharp-edged end piece projecting from the buckle, which may lead to injuries in the subsequent handling.

In another tool for mounting a tension clamp, as known from U.S. Pat. No. 3,641,629, a buckle is mounted on a band by means of two counter-acting plier jaws, each of which has an inclined surface to engage a lateral window in the buckle. The inclined surfaces are convex at their upper sides and produce a convex hump in the band to be locked in an aperture of the buckle. Higher tensional forces occurring in the band will entail the risk of the hump slipping out of the aperture so that the locking will open.

SUMMARY OF THE INVENTION

The invention is based on the object to avoid, at least in part, the disadvantages which exist with comparable prior art tools. A more specific object maybe seen in providing a tool of the type described above by which a tension clamp maybe mounted with the force required for a secure fixation and without any substantial influence on the object to be fastened.

This object is achieved by the invention. In the tool formed in accordance with the invention, a locking device has means which may be moved into a lateral window of the buckle for deforming a side edge of the outer band end portion. The deforming forces act parallel to the surface of the object to be fastened and are supported by the tool. The object or structural member is thus not influenced or required within the area of the buckle even when relatively high deforming forces are exerted on the buckle to achieve a secure locking.

The locking device has preferably two plier jaws adapted to move into opposite windows of the buckle for simultaneously deforming both side edges of the outer band end portion. This prevents transverse forces from acting on the buckle and the locking takes place symmetrically.

In another embodiment, the plier jaws have inclined surfaces at their sides which are remote from the inner band end portion during the deforming process, and the width of the plier jaws corresponds to the clear width of the windows as measured in the longitudinal direction of the band. This allows the portions of the band lying within the area of the window to be notched and bent up, wherein the windows of the buckle themselves form the cutting edges for the notching. Part of the occurring wear thus takes place on the buckle rather than on the tool.

The severing device for shearing off the band preferably has a shearing member movable in a direction transverse to the longitudinal direction of the band wherein the shearing member, in shearing off the band, cooperates with a part of the buckle so that part of the wear takes place on the buckle rather than on the tool also in this process. The edge of the shearing member facing the buckle is rounded off to avoid abrasion of material (e.g. of a coating) when the tension clamp is inserted.

In an embodiment, the severing device has two counter-acting plier jaws with cutting edges for notching both edges of the outer band end portion at the end face of the buckle remote from the inner band end portion. Preferably, the plier jaws have inclined surfaces for bending up triangular parts of the band portion to be severed. This arrangement performs the severing without forces acting on the object to be fastened.

In further embodiments, the surfaces of the locking and, respectively, severing device, which effect the notching process and/or the severing process are grooved to counter-act the generation of chips, or if generated, keep them as small as possible.

Preferable, the part of the locking device to be moved into the lateral windows of the buckle may be controllable in such a manner that it serves to fix the buckle during the severing step, thus fulfilling a further purpose.

The locking device and the severing device maybe controllable by a common crank, preferably in a manner that the locking device is released from its engagement in the windows of the buckle after the severing step.

In a further embodiment, the device for tensioning the band round the object to be fastened has a clamping mechanism which is movable away from the buckle holder to clamp the outer band end portion. For accelerating the tensioning process, the movement of the clamping mechanism is controlled in its first part dependent on distance and then dependent on force, wherein the change-over from distance control to force control takes place at a predetermined force threshold.

DRAWINGS

Embodiments of the invention are explained below with reference to the drawings, in which:

FIGS. 1*a* and 1*b* show a tension clamp in two stages of its deformation;

EMBODIMENTS

Figure 1A:
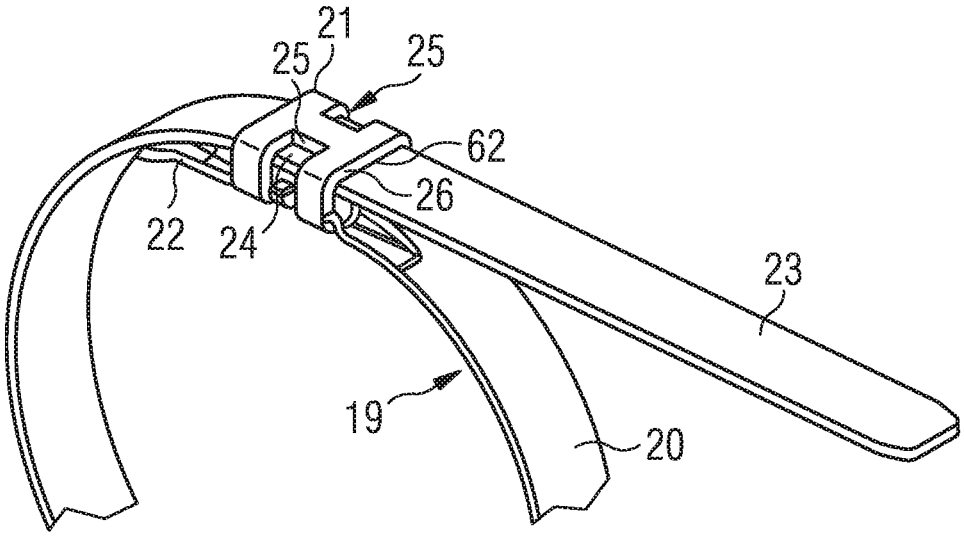
Figure 1B:
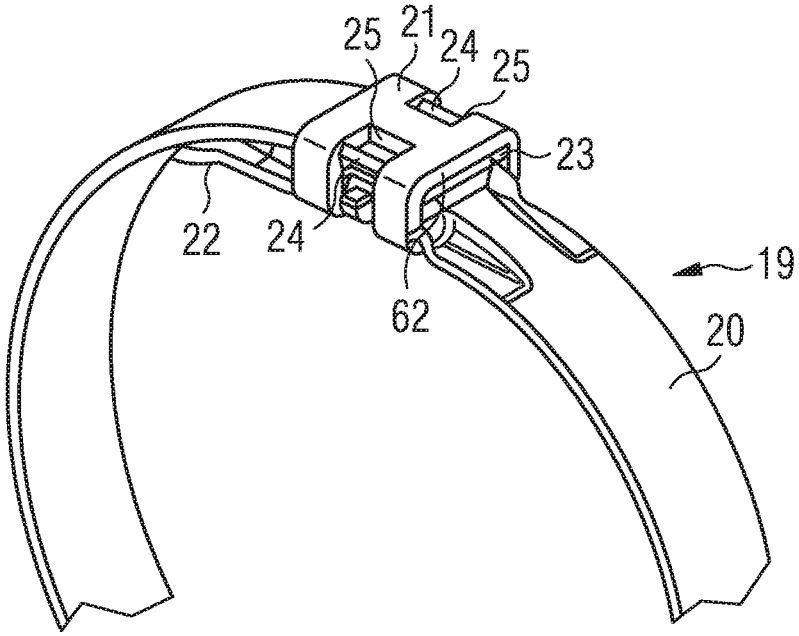

The tension clamp 19 shown in FIGS. 1*a* and 1*b* of the drawings includes a band 20 and a buckle 21. Both parts are preferably made of metal. FIG. 1*a* illustrates a condition in which the buckle 21 of the tension clamp 19 is fixed at the inner band end portion 22, the band 20 is placed round an object to be fastened (not shown), and the outer band end portion 23 is fed through the buckle 21. During the final mounting, the band 20 is tensioned round the object to be fastened by pulling its outer end portion 23, in the tensioned condition the outer end portion 23 is locked by deforming parts 24 of its side edges (FIG. 1*b*) in the area of lateral windows 25 of the buckle 21, and excessive band length is removed at the rear end face 26 of the buckle 21.

Figure 2:
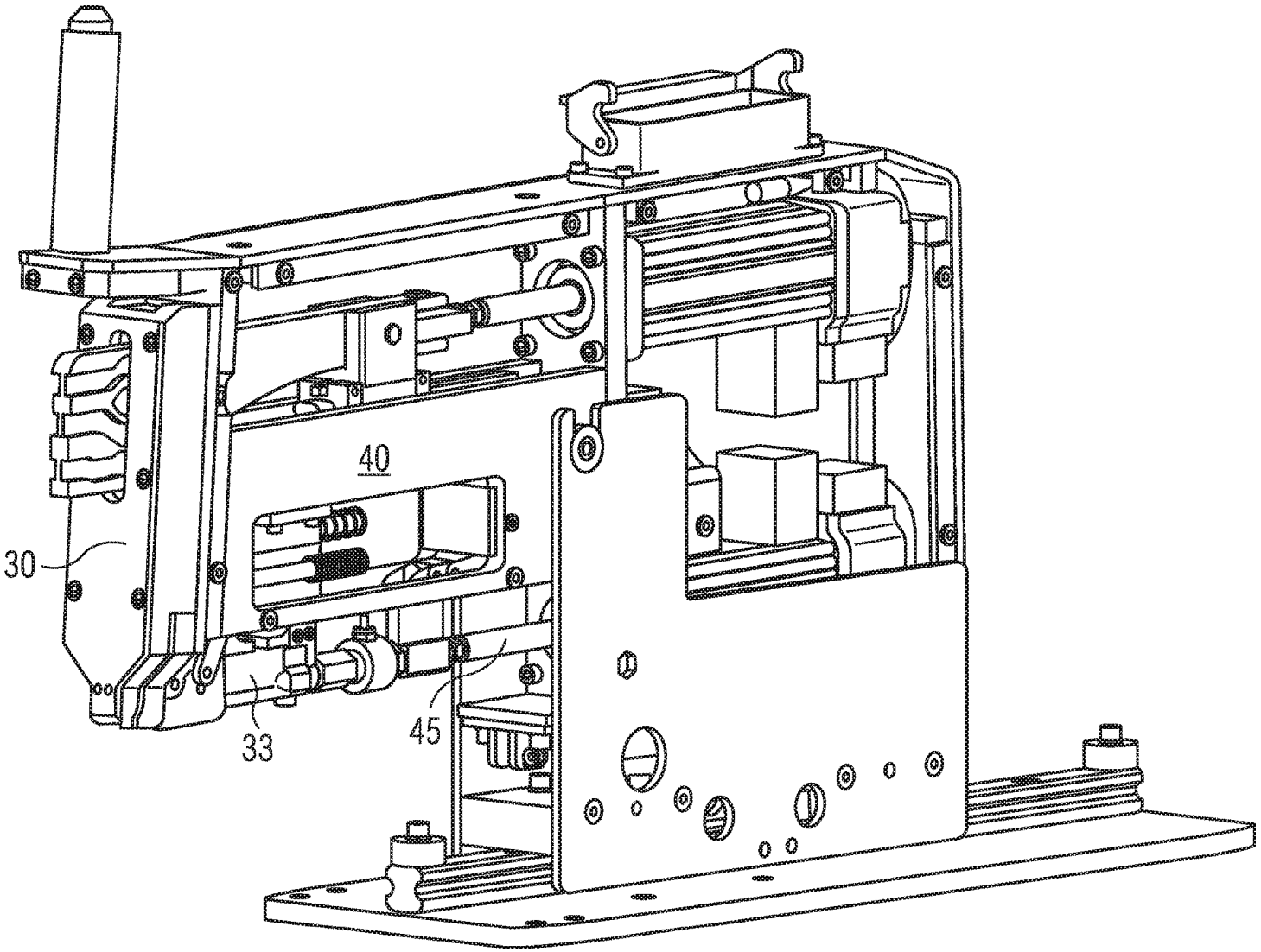
FIG. 2 shows a tool for mounting a tension clamp.

The tool shown in FIG. 2 includes a holding device for holding the tension clamp 19 and the object to be fastened (not shown) which is surrounded by the clamp, a tensioning device for tensioning the tension clamp 19 round the object to be fastened, a locking device 50 for locking the band 20 to the buckle 21 in the tensioned condition, and a severing device for severing excessive band length. These devices are explained in more detail below.

Figure 3:
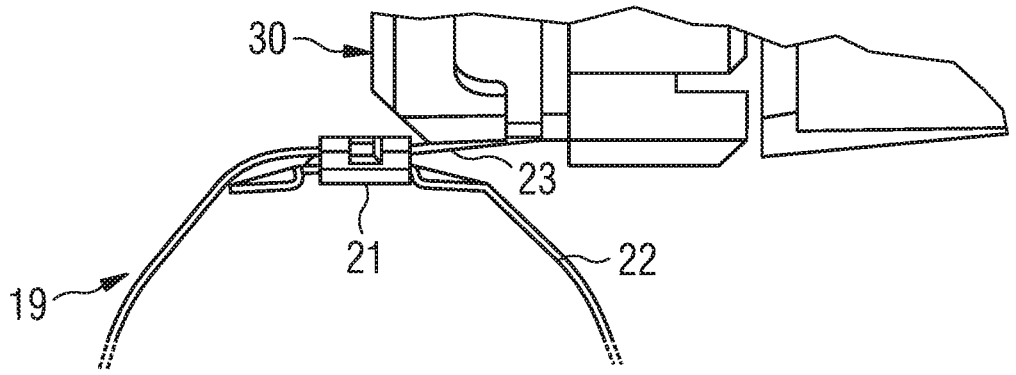
FIG. 3 is a partial view of the tool with a tension clamp inserted.
Figure 4:
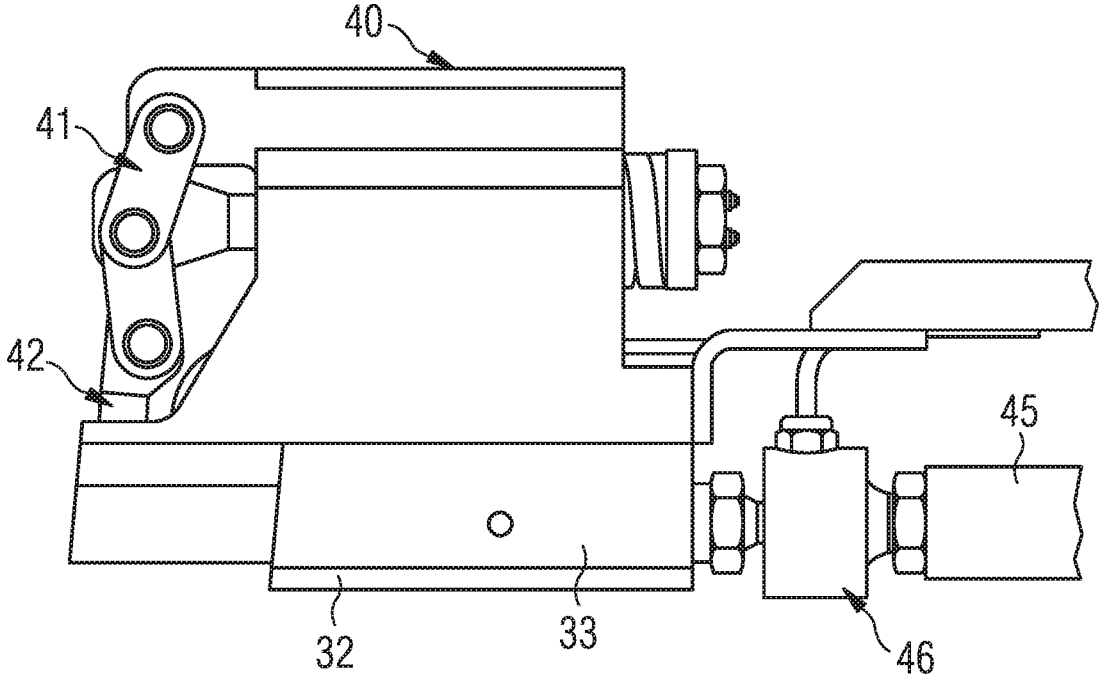
FIGS. 4 to 7 show a holding device for holding and tensioning the tension clamp.
Figure 5:
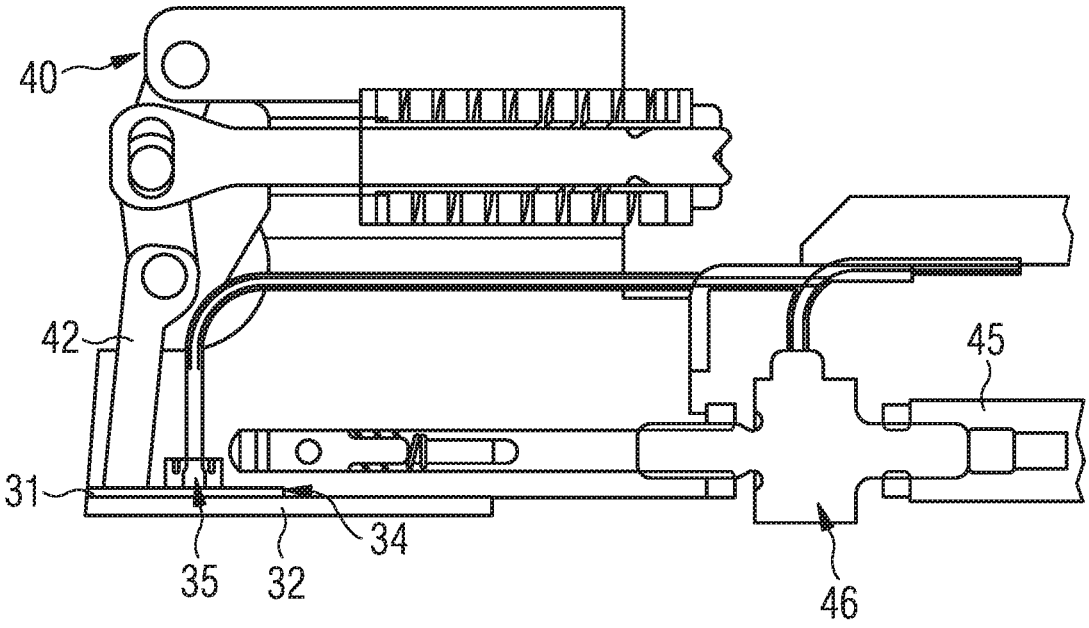
Figure 6:
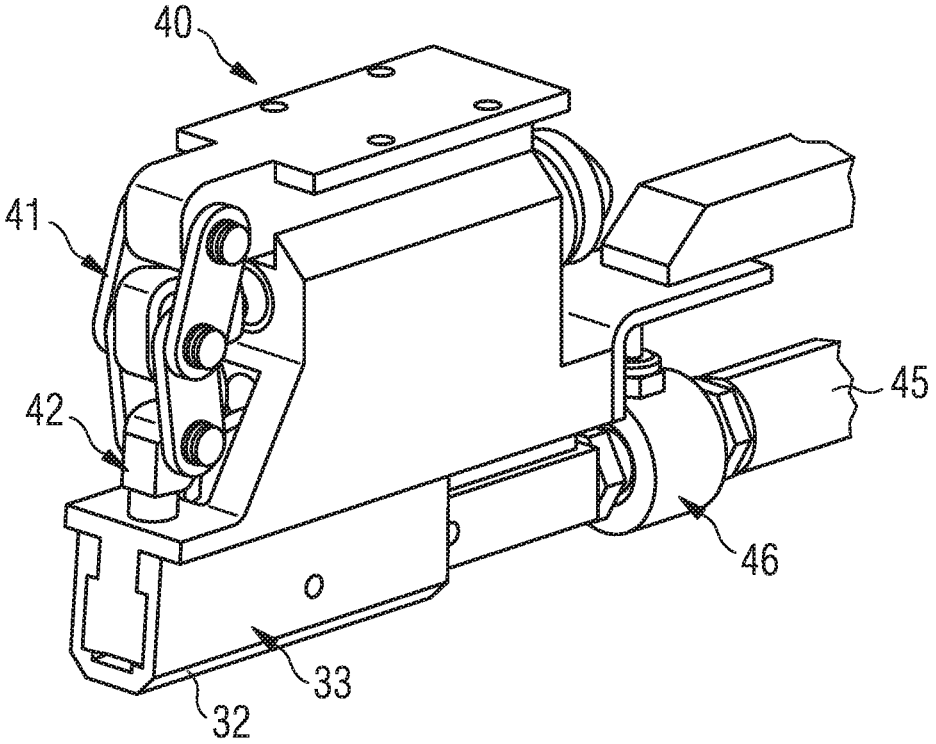
Figure 7:
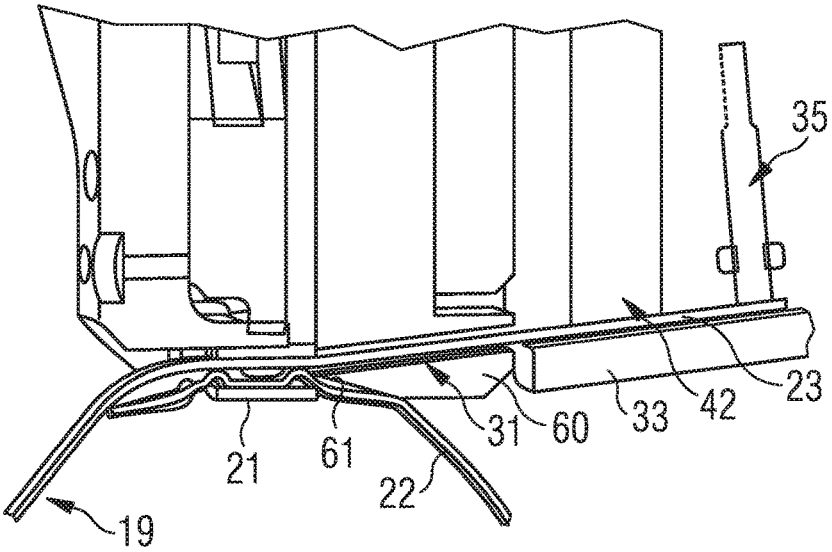

As shown in FIGS. 3 and 7, the outer band end portion 23 of the tension clamp 19 is inserted in a passage 31 (FIG. 7) provided in the lower part of the tool head 30 to such a maximum extent that the band 20 abuts a stop 34 (FIG. 5) integrated in a body of the clamping mechanism. A proximity sensor 35 (FIGS. 5 and 7) makes sure that band is present in the tool and has been moved into the passage 31 to a sufficient extent.

In this position, the band 20 is fixed by a clamping mechanism 40 which is shown in FIGS. 4 to 7 and constitutes the holding and which includes a plunger 42 driven by a toggle lever 41. When the clamping mechanism 40 is driven by actuating a start button (not shown) or by an electronic control, the plunger 42 is lowered to fix the band 20 by pressure against the bottom portion 32 of the slider 33.

Subsequently, the band 20 is tensioned round the object to be fastened by the tensioning device (FIGS. 4 to 6) pulling the outer band end portion 23. The tensioning force is applied by an electrically actuated cylinder having a piston rod 45 which moves the entire clamping mechanism 40 and all associated parts such as the proximity sensor 35 and the slider 33 to the right until a predetermined force value is detected by a load cell 46.

To shorten the time required for the tensioning process, the piston rod 45 may be controlled at first dependent on distance and in the final part of the movement, when a predetermined tension is reached, dependent on force.

Figure 8:
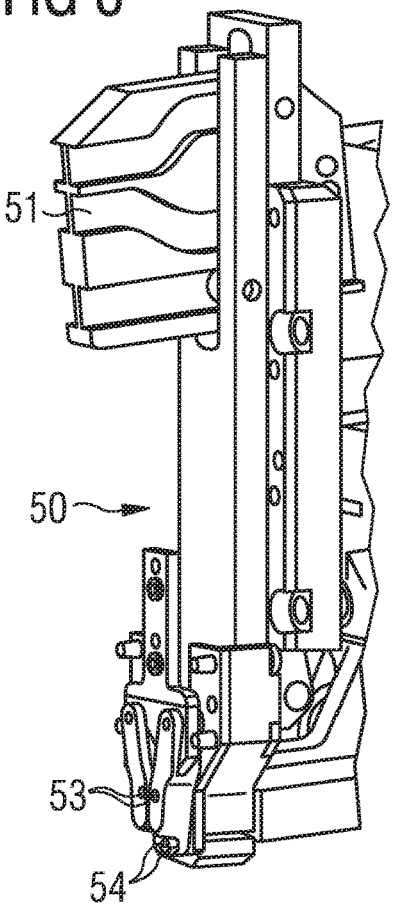
FIGS. 8 to 10 show a device for locking the buckle on the tension clamp.
Figure 9:
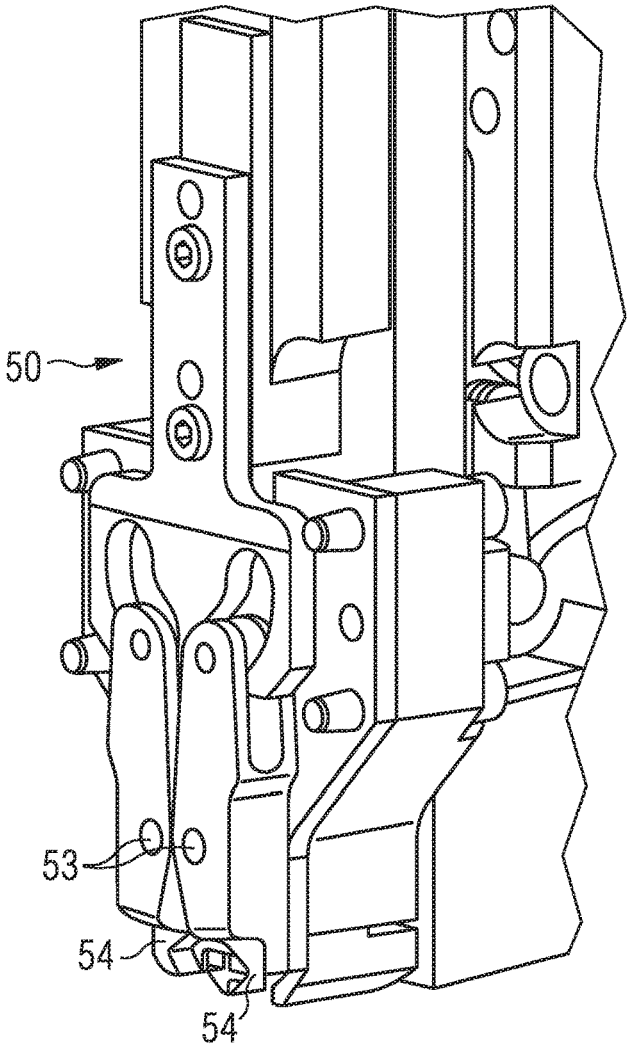
Figure 10:
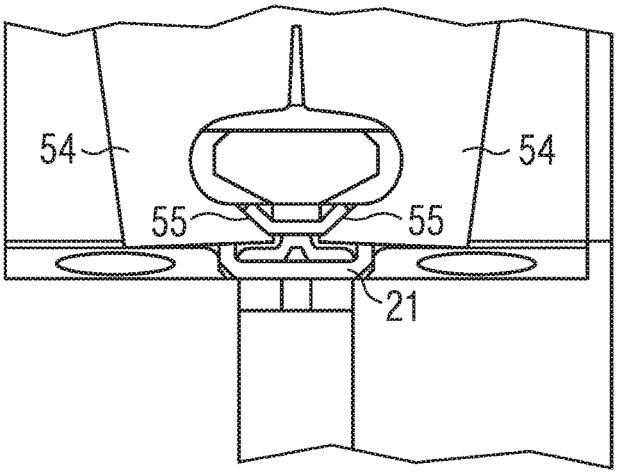

In this position, the locking device 50 shown in FIGS. 8 to 10 is operated to lock the buckle 21 on the band 20. A locking device 50, which is arranged on the tool head 30 and is downward movable through a control crank 51 includes a pair of plier jaws 54 which are pivotal on pins 53, each jaw 54 having an inclined surface 55 (FIGS. 10 and 12) at their lower ends.

In this condition, the plier jaws 54 are moved toward each other by the control crank 51 so as to engage the windows 25 of the buckle 21, and their inclined surfaces 55 notch and bend up the side edge portions 24 of the band at the edges of the windows (see FIG. 1*b*). The width of the plier jaws 54 corresponds to the clear width of the windows 25 measured in the longitudinal direction of the band. This achieves a locking between the band 20 and the buckle 21 substantially free of play. Since the buckle 21 itself is used for notching shearing the side edge portions 24 of the band 20, the buckle takes up part of the wear.

Figure 11:
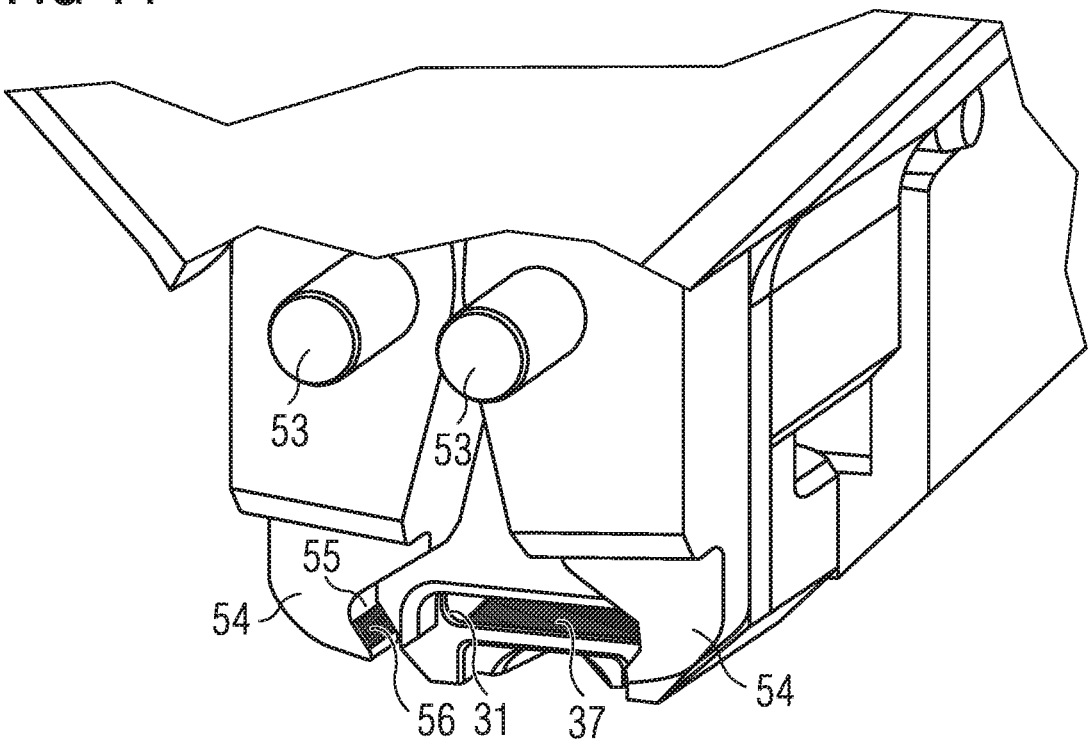
FIG. 11 is an enlarged view of the lower part of the locking device shown in FIGS. 8 and 9.
Figure 12:
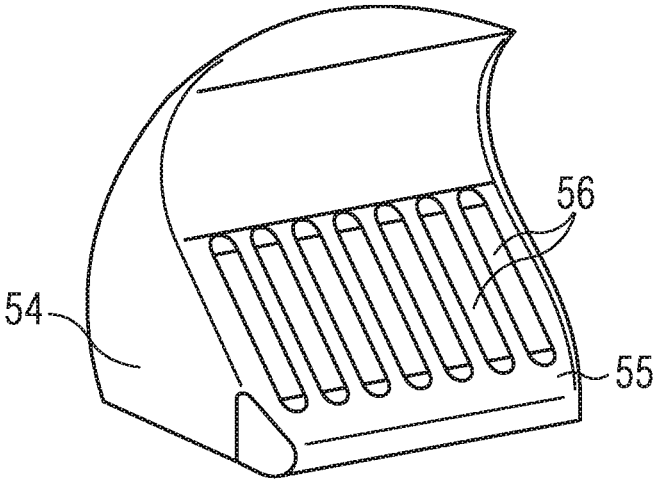
FIG. 12 shows a detail in a further enlarged view.

As seen in the enlarged representations of FIGS. 11 and 12, the inclined surfaces 55 of the plier jaws 54 are provided with grooves 56 in order to counter-act the generation of chips or, if generated, keep them as small as possible, when the side edge portions 24 are notched.

By the further movement of the control crank 51 (FIG. 8), the severing device is raised whereby the length of the outer band portion 23 projecting from the buckle 21 is sheared off between a cutting edge 61 (FIGS. 7 and 11) formed on a lower part 60 of the passage 31 and an edge 62 at the end face 26 of the buckle 21 (FIG. 1*b*). The cutting edge 61 rounded to avoid excessive wear of the band 20. During the shearing process, the buckle 21 continues to be fixed by the plier jaws 54 of the locking device 50.

The plier jaws 54 are subsequently opened to prevent them from becoming stuck in the windows 25 of the buckle 21 and failing to release the buckle 21.

Then, the piston rod 45 is moved to the left in the drawings whereby the plunger 42 of the clamping mechanism 40 releases the severed part of the outer band portion 23 which is still clamped. The slider 33 is then moved to the left so that the severed porting of the outer band portion 23 is set free and can fall out of the tool.

Figure 13:
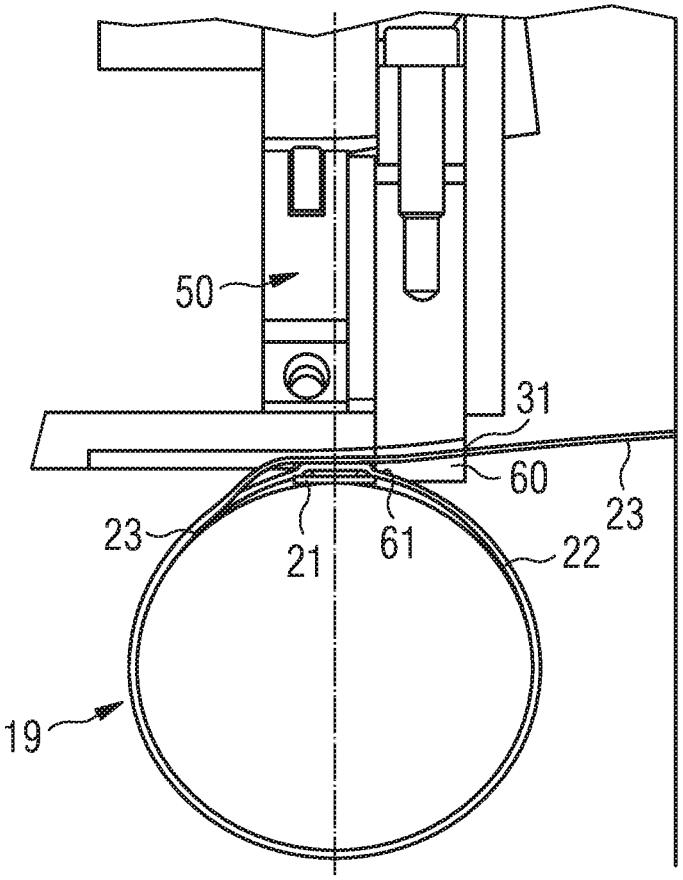
FIGS. 13 to 17 show various embodiments of a severing device for severing excessive band length.

In the severing device explained with reference to FIGS. 7 and 13, the excessive band length is cut off by moving the part of the tool forming the passage 31 upward, i.e. away from the tension clamp and the object to be fastened. Since an edge formed on the end face 26 of the buckle 21 is used for this shearing movement, the buckle 21 again takes up part of the wear and the tool is saved. At the same time, a sharp-edge end of the band 20 is prevented from projecting from the buckle 21.

As shown in FIG. 11, the lower surface of the passage 31, which co-operates with an edge of the buckle 21 in severing the excessive band portion 23, is provided with grooves 37 which are shaped and dimensioned similar to the grooves 56 in the plier jaws 54 and again serve the purpose of counter-acting the generation of chips or, if generated, keeping them as small as possible.

Figure 14:
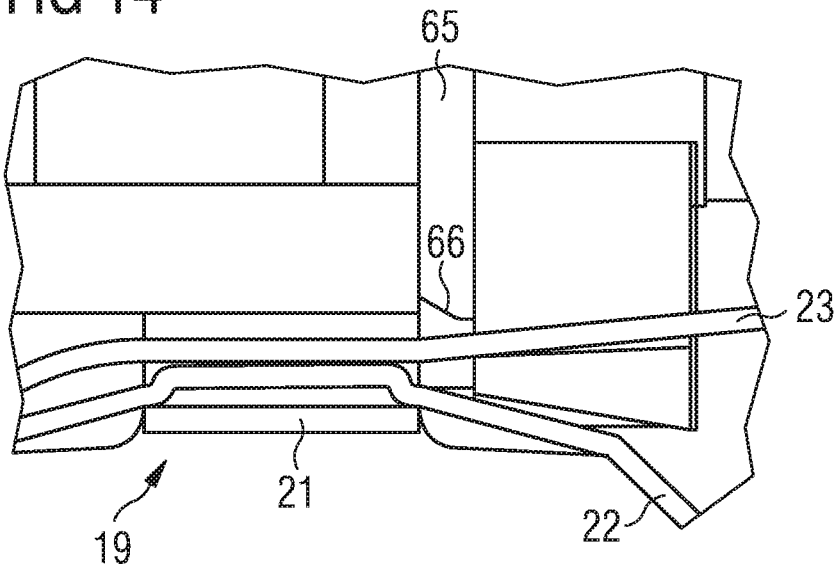

In the alternative embodiment of the severing device shown in FIG. 14, the excessive band length is cut off by a knife 65 which is moved in the direction of the tension clamp and shears against the surface of the surface of the passage 31. The knife 65 is chamfered at 66 to press the projecting band against the buckle 21 thereby avoiding sharp edges.

Figure 15:
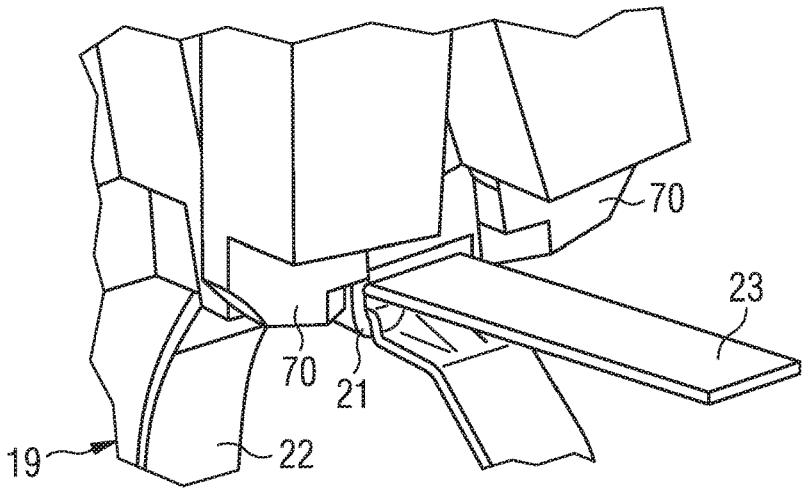

The further embodiment of the severing device shown in FIG. 15 uses plier jaws 70 which act against one another to notch both sides of the band 20 on the outer side of the buckle 21. In this process, a narrow centre web of the band 20 is left, which is subsequently torn off. This again saves the tool.

Figure 16:
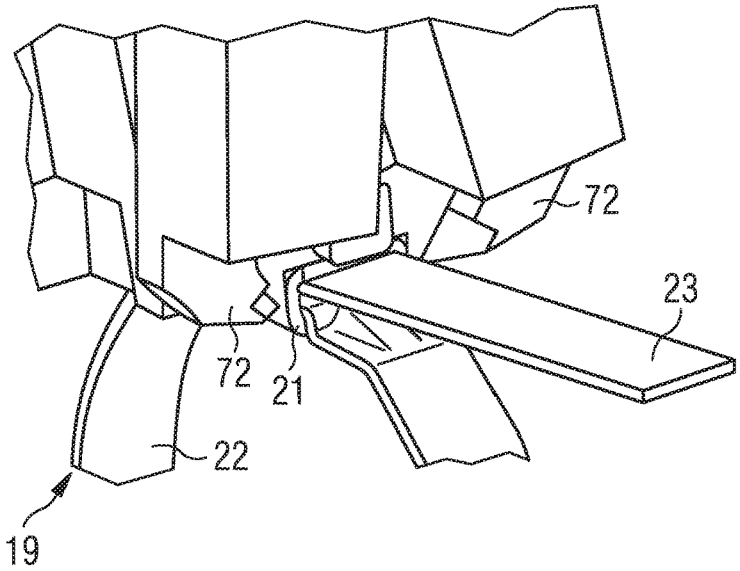
Figure 17:
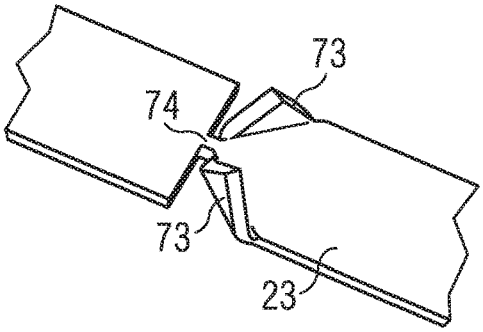

In the embodiment of the severing device shown in FIG. 16, plier jaws 72 are provided which have inclined surfaces similar to those of the plier jaws 54 of the locking device, for folding up triangular portions 73 (FIG. 17) of the band part to be cut off. This again leaves a narrow centre web 74, which is subsequently torn off.

In the severing devices shown in FIGS. 14 to 17, the parts of the tool which sever the band portion 23 may also be grooved similar to the passage 31 in FIG. 11 in order to counter-act the generation of any chips or, if generated, keep them as small as possible.

Figure 18:
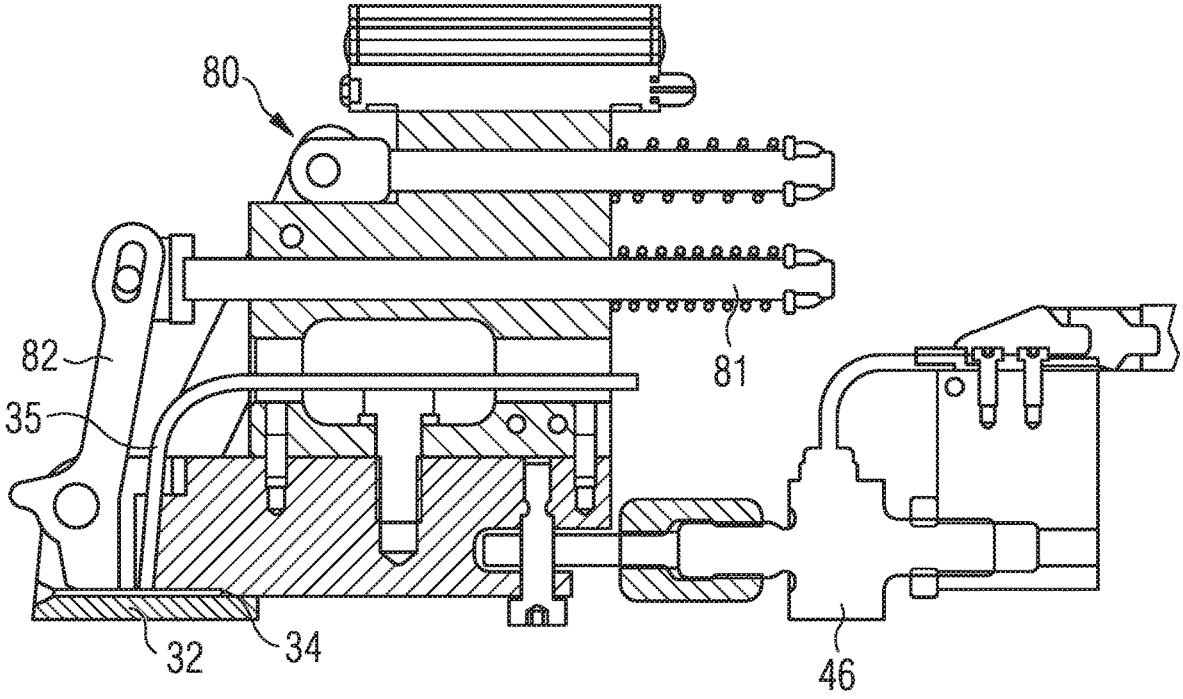
FIG. 18 is a view similar to FIG. 5 of an alternative holding device.

In the alternative illustrated in FIG. 18, the clamping mechanism 80 has an eccentric lever 82 which can be rotated by means of a piston rod 81. When the piston rod 81 moves to the right the eccentric lever 82 is rotated and fixes the band by pressing it against the bottom part 32 of the slider. After the excessive length of the outer band section has been cut off, the piston rod 81 is moved to the left so that the severed band portion becomes free to fall out of the tool.

REFERENCE NUMBERS

19 Tension clamp
20 Band
21 Buckle
22 Inner band end portion
23 Outer band end portion
24 Side edge portions (of 20)
25 Window
26 End face (of 21)
30 Tool head
31 Passage
32 Bottom part (of 33)
33 Slider
34 Stop
35 Proximity sensor
37 Grooves
40 Clamping mechanism
41 Toggle lever
42 Plunger
45 Piston rod
46 Load cell
50 Locking device
51 Control crank
53 Pins
54 Plier jaws
55 Inclined surfaces
56 Grooves
60 Lower part (of 31)
61 Cutting edge
62 Edge (of 26)
63 Control crank
65 Knife
66 Chamfer (of 65)
70 Plier jaws
72 Plier jaws
73 Triangular parts
74 Centre web
80 Clamping mechanism
81 Piston rod
82 Eccentric lever

The invention claimed is:

1. A tool for mounting a tension clamp (19) surrounding an object to be fastened, the clamp having a band (20) surrounding the object to be fastened and a buckle (21) mounted on a first band end portion (22) and surrounding the band (20), wherein a second band end portion (23) extends through the buckle (21), the tool comprising;

a holding mechanism for holding the buckle (21) including the band (20) surrounding the object to be fastened;

a tensioning device for tensioning the band (20) around the object to be fastened by applying tension to the second band end portion (23);

a locking device (50) for locking the buckle (21) on the band (20) having two plier jaws (54) adapted to be inserted into two lateral windows (25) of the buckle (21) for simultaneously bending side edges of the second band end portion (23) without bending side edges of the first band end portion (22); and a severing device for severing any excess band length, characterised in that each of the plier jaws (54) has an inclined surface (55) with a width corresponding to a width of the corresponding window (25) as measured in the longitudinal direction of the band and is adapted to be actuated so as to shear and bend upward a portion (24) of the side edge of the second band end portion (23) at the window (25), wherein said shearing is achieved at edges of the respective window (25) of the buckle (21) such that the buckle (21) itself will shear the side edge of the second band end portion (23).

2. The tool of claim 1, wherein the inclined surfaces (55) are provided with grooves (56).

3. The tool of claim 1, wherein the severing device includes a shearing member movable in a direction transverse to the longitudinal direction of the band for cutting off the second band end portion (23) at an end face (26) of the buckle (21) remote from the first band end portion (22).

4. The tool of claim 3, wherein the shearing member is provided with grooves (37) in its surface.

5. The tool of claim 3, wherein the shearing member co-operates with an edge (62) provided at the end face (26) of the buckle (21).

6. The tool of claim 5, wherein an end of the shearing member remote from the buckle (21) is rounded.

7. The tool of claim 1, wherein the severing device has a second pair of plier jaws (70; 72) operating against one another and having cutting edges for notching both sides of the second band end portion (23) at an end face (26) of the buckle (21) remote from the first band end portion (22).

8. The tool of claim 7, wherein the plier jaws (72) of the severing device have inclined surfaces.

9. The tool of claim 1, wherein the locking device, which can be inserted in a lateral window (25) of the buckle (21), is controllable in such a manner that the locking device serves to fix the buckle (21) during the severing step.

10. The tool of claim 9, wherein the locking device (50) is controllable in such a manner that the locking device is released of its engagement in the window (25) of the buckle (21) after operation of the severing device.

11. The tool of claim 1, wherein the locking device (50) and the severing device are controllable by a common control crank (51).

12. The tool of claim 1, wherein the tensioning device has a clamping mechanism for clamping the second band end portion (23) which is movable away from the holding mechanism.

13. The tool of claim 12, wherein the tensioning device has a load cell (46) for monitoring any tensional force on the second band end portion (23).

14. The tool of claim 13, wherein the movement of the clamping mechanism is controllable dependent on distance moved reaching a predetermine tension force.

15. The tool of claim 1, wherein the holder includes a proximity sensor (35) for detecting whether the band (20) is present in the tool.

16. A tool for mounting a tension clamp (19) surrounding an object to be fastened, the clamp having a band (20) surrounding the object to be fastened and a buckle (21) mounted on a first band end portion (22) and surrounding the band (20), wherein a second band end portion (23) extends through the buckle (21), the tool comprising;

means for holding the buckle (21) including the band (20) surrounding the object to be fastened;

means for tensioning the band (20) around the object to be fastened by applying tension to the second band end portion (23);

means for locking the buckle (21) on the band (20) adapted to be inserted into two lateral windows (25) of the buckle (21) and simultaneously bend both side edges of the second band end portion (23) without bending side edges of the first band end portion (22);

means for severing any excess band length; and wherein the means for locking the buckle (21) on the band (20) has an inclined surface (55) with a width corresponding to a width of the lateral window (25) as measured in the longitudinal direction of the band and is adapted to be actuated so as to shear and bend upward a portion (24) of a lateral edge of the second band portion in the two lateral windows (25), and wherein said shearing is achieved at edges of the respective window (25) of the buckle (21) such that the buckle (21) itself will shear the side edge of the second band end portion (23).

* * * * *